US005558064A

United States Patent [19]

Buslepp

[11] Patent Number: 5,558,064

[45] Date of Patent: Sep. 24, 1996

[54] ADAPTIVE ENGINE CONTROL

[75] Inventor: Kenneth J. Buslepp, Brighton, Mich.

[73] Assignee: General Motors Corporation, Detroit, Mich.

[21] Appl. No.: 545,125

[22] Filed: Oct. 19, 1995

[51] Int. Cl.[6] ..... F02M 51/00

[52] U.S. Cl. ..... 123/480

[58] Field of Search ..... 123/480, 486, 123/478, 494; 364/431.05, 431.11

[56] References Cited

U.S. PATENT DOCUMENTS 5,065,726 11/1991 Klenk ..... 123/480
5,284,116 2/1994 Richeson et al. ..... 123/425
5,307,276 4/1994 Takahashi et al. ..... 364/431.05
5,337,719 8/1994 Togai ..... 123/478
5,448,978 9/1995 Hasegawa et al. ..... 123/480

*Primary Examiner*—Raymond A. Nelli
*Attorney, Agent, or Firm*—Michael J. Bridges

[57] ABSTRACT

Internal combustion engine control includes a dynamic block learn array structure which is adaptable in accord with monitored closed-loop control activity. Cells are consolidated when neighboring cells call for a substantially common control correction, with the most current block learn information replacing more obsolete block learn information. A persistent need for additional compensation despite the block learn activity triggers addition of cells to the structure, or triggers redefinition of cell boundaries to most effectively learn the appropriate compensation.

9 Claims, 5 Drawing Sheets

ADAPTIVE ENGINE CONTROL

FIELD OF THE INVENTION

This invention relates to automotive controllers and, more particularly, to adaptive engine air/fuel ratio control.

BACKGROUND OF THE INVENTION

Engine controllers are generally known in which learning of engine control correction factors is provided by maintaining an array of block learn cells. Each cell is assigned a correction factor. Cells are arranged and referenced according to the current level of certain engine operating parameters, such as engine airflow rate, engine load, engine intake manifold pressure, and engine speed. A cell becomes active when referenced by the current level of at least one engine operating parameter. When active, the cell undergoes a learning process in which the cell value is adjusted in direction to drive engine control performance toward a desired performance. The cell value may then be applied to a control command issued in an engine control procedure.

The range of engine operating levels covered by a specific cell are traditionally determined during a calibration process and are static. The cells may be stored in a non-volatile memory device to retain the cell information for application over successive engine operating cycles. The amount of updating (learning) of each cell may vary. Cells defined by engine operating level ranges including more active engine operating levels may benefit from repeated activation and thus repeated learning, while more dormant cells may receive little of such benefit. Accordingly, even adjacent cells may have significantly diverging cell values. When a reference parameter, such as engine airflow or engine speed changes leading to a transition between cells, a substantial change in cell values may occur, leading to a step change in an engine control command. Such an adjustment may cause a perceptible engine transient, reducing engine performance and perhaps reducing confidence in engine stability.

Certain engine operating levels may require significant cell value learning away from initial values, while other parameter levels may not. If fixed calibrations dictate the engine parameter levels that form the cell boundaries, values in adjacent cells may learn away from each other to the extent that significant control perturbations may result when transitioning between the cells. As described, such transitioning is not desirable.

It would therefore be desirable to provide for the described benefits of block learning in a cell array that mitigates significant changes between cells. The cell array should nonetheless preserve the block learn benefit of ensuring that proper compensation for the various engine operating levels are learned and stored in the corresponding cells.

SUMMARY OF THE INVENTION

The present invention provides for developing and maintaining a desirable block learn array with flexible cell boundaries that adapt to changing engine operating conditions to maintain the effectiveness of the correction factor learned in each cell while substantially reducing the change in the correction factor between adjacent cells.

More specifically, the present invention dynamically maintains the cell array in accord with the relationship between neighboring cells so that new cells are added when needed and old cells with substantially obsolete cell values may be learned up into more current cells when necessary.

The structure starts with a minimum number of cells. As control performance requires substantial corrective action at various operating levels, cells are added for such levels and learning in such cells is enabled. When values in adjacent cells begin to approach each other, such as when control disturbances subside, cells are removed from the structure by learning them up into cells containing more current learning information. The number of cells in the array and the engine operating parameter range they cover is substantially unbounded.

More specifically, a cell from a block learn array of adjacent cells is defined as active when the current engine operating level is within a range of such levels corresponding to the cell. If learning is active, such as when a developed cell is active, the cell value of the active cell is allowed to learn using engine control performance information. If the learned cell value is substantially the same as an adjacent cell with less current cell information, the two cells are merged into a single cell extending over the ranges of both of the cells, and the more recent cell value is imputed to the single cell. If the current engine operating level is outside the range of developed cells of the array, the closest cell is activated. If the active cell is determined to not be effectively compensating the engine control process, a cell may be added having a range defined by the current engine operating level and an adjacent cell boundary and having a cell value corresponding to the current cell value, whether adjusted during a learning process or not.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
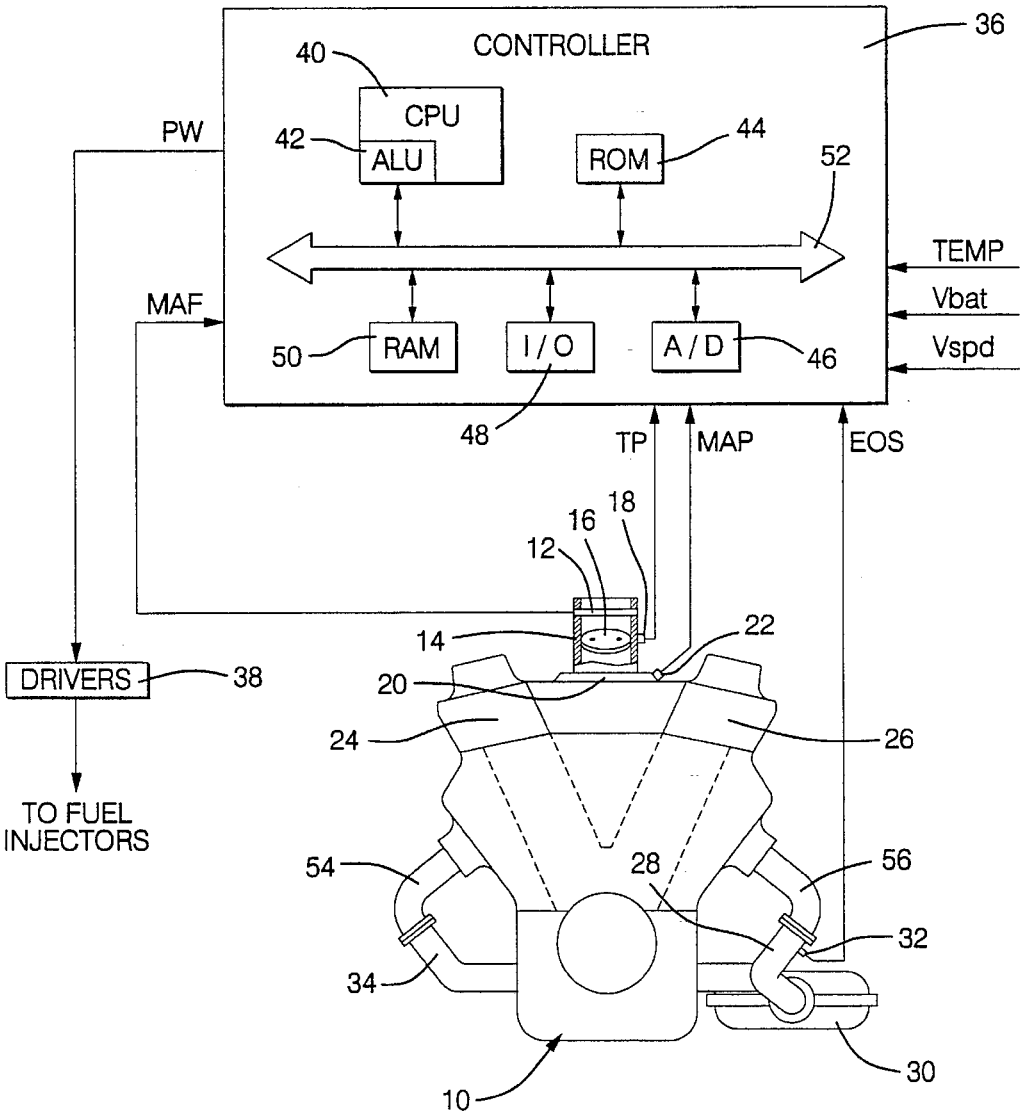
FIG. 1 is a general diagram illustrating the engine and engine control hardware for carrying out this invention in accord with the preferred embodiment.

Referring to FIG. 1, internal combustion engine 10 receives intake air past conventional mass airflow sensor 12 into an intake manifold 20 via intake air bore 14 in which is rotatably disposed intake air valve 16 such as a conventional butterfly or rotary valve which may be manually positioned to vary the restrictiveness of the intake air path to engine intake air. The rotational position of the intake air valve is transduced into signal TP by conventional rotary position sensor 18 such as a generally-available rotary potentiometric position sensor. The mass airflow meter 12 may be of the conventional hot wire or film type, transducing the mass of air being received into the bore 14 into signal MAF.

The absolute air pressure of the intake air received in the intake manifold 20 is transduced by conventional pressure transducer 22 into output signal MAP. The intake air is distributed by the manifold 20 to each of a plurality of engine cylinders (not shown) via a corresponding set of intake air passages of any conventional design (not shown). The intake air passing through the intake air passages is combined with an injected fuel quantity and the mixture delivered to the corresponding engine cylinder for ignition therein. The ignition process drives an engine output shaft (not shown), such as a conventional crankshaft mechanically linked through a drivetrain to certain vehicle wheels for driving such vehicle wheels. The engine cylinders may be grouped into one or more cylinder banks, such as a first bank of four cylinders 24 and a second bank of four cylinders 26 in the eight cylinder v-type engine of this embodiment. The first bank 24 of this embodiment exhausts gas produced in the cylinder ignition process into exhaust manifold 54 which guides the exhaust gas to exhaust gas conduit 34. The second bank 26 likewise exhausts gas produced in the cylinder ignition process into exhaust manifold 56 which guides the exhaust gas to the conduit 34. The exhaust gas in the conduit 34 is passed to conventional three-way catalytic treatment device 30 for catalytic treatment. The oxygen content of the exhaust gas passing through the exhaust gas conduit 34 is transduced into signal EOS by exhaust gas oxygen sensor 32 which may be a conventional zirconia oxide sensor exposed to a representative sample of exhaust gas passing through the conduit 34. The signal EOS is used in a determination of engine actual air/fuel ratio, as will be further detailed.

Engine temperature is determined through any conventional means such as through a conventional engine coolant temperature transducer (not shown) placed in the path of flow of engine coolant for outputting signal TEMP indicating engine coolant temperature. An electrical power supply, such as a conventional automotive battery (not shown) provides an output voltage signal Vbat, used in standard startup operations and as a stable electrical power supply. Speed sensors, such as vehicle wheel speed sensors generally known in the art (not shown) or a sensor for sensing a rate of rotation of a transmission output shaft (not shown) provide a signal Vspd indicating speed of the automotive vehicle in which the engine 10 and engine control hardware of FIG. 1 are provided in this embodiment.

Controller 36 takes the form of a conventional automotive controller such as a single chip microcontroller including such conventional elements as a central processing unit CPU 40 having arithmetic logic circuitry ALU 42 for performing mathematical and logical operations on data in accord with stored program instructions, and control circuitry for directing various controller elements to perform dedicated functions according to a timing specified in the program instructions or in hardware. The controller further includes random access memory devices RAM 50 including both volatile and non-volatile devices for data storage functions to support rapid data storage and access operations by the CPU 40 as directed by the control circuitry thereof, and read only memory devices ROM 44 for long term, non-volatile data storage functions to support storage of controller instruction sets, critical data values that are required beyond the vehicle operating cycle in which they were determined, etc. Still further, the controller includes input/output devices I/O 48 for carrying out data transmit and receive operations as directed by the control circuitry of the CPU 40, including sampling of input signals provided to the controller including signals TP, MAP, TEMP, Vbat, Vspd, and EOS, and for outputting, at times specified by CPU 40, various output drive signals including the signal PW applied to fuel injector drivers 38. Input signal values may be translated into digital equivalents via analog to digital circuitry A/D 46 so as to provide the signal information in a form usable by the controller 36. The controller elements may communicate via a standard data and address bus network 52, as is generally known in the art.

Fuel injector drivers 38 consists of at least one fuel injector driver circuit for driving at least one fuel injector (not shown) to deliver a commanded fuel quantity to engine cylinder intake air passages. The fuel quantity is determined through engine controller operations and converted to an equivalent fuel injector pulse width PW, the duration of which corresponds to an injector opening time during which opening time pressurized fuel passes through the open injector to the intake air passage. The PW command is periodically updated to reflect evolving engine fueling requirements, and is coordinated with engine angular position information so as to be applied by the drivers 38 to the one of the fuel injectors undergoing its fuel injection event, such as just before the intake stroke for the corresponding engine cylinder in a four stroke, sequential fuel injection embodiment of this invention.

The command from the drivers to the at least one fuel injector is in the form of a pulse width modulated, fixed amplitude, variable duty cycle drive signal, wherein the duty cycle corresponds to an injector opening time, in accord with well-established fuel injection control principles. Other conventional fuel delivery approaches may be substituted for that of the present embodiment without departing from the scope of this invention, through the exercise of ordinary skill in the art.

The series of operations executed by the controller 36 of FIG. 1 for carrying out this invention in accord with a preferred embodiment include conventional ignition control operations, open loop fueling operations, and diagnostic and maintenance operations. Additionally, the operations of FIGS. 4–6 are executed to provide closed-loop fueling control benefiting from an adaptive cell boundary determination for fuel block learn cells.

Figure 2:
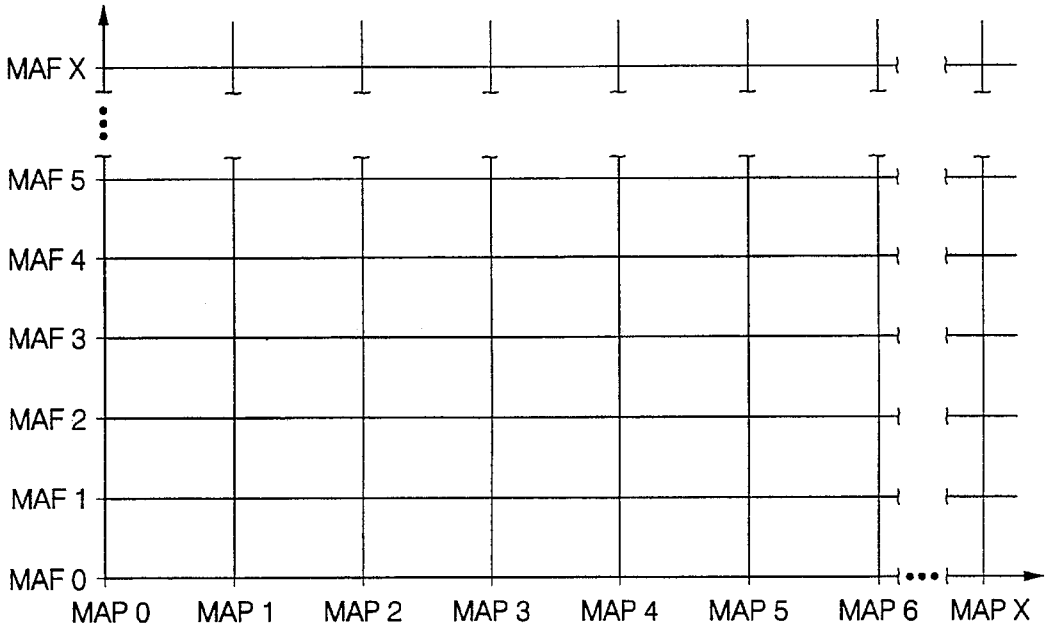
PRIOR ART FIG. 2
FIG. 2 is a diagram of a prior art block learn cell structure.

FIG. 2 illustrates prior art block learn cell structure in which a plurality of cells, stored in non-volatile RAM devices 50 (FIG. 1) are indexed by fixed parameter values, such as fixed values of mass airflow MAF and manifold absolute pressure MAP. The fixed values are determined through a calibration process and do not change. Generally, the current MAF and MAP are used as lookup indices into the block learn table to reference a block learn value corresponding to the conditions. The referenced block learn value is adjusted in accord with a closed-loop air/fuel ratio control process and is applied as a direct multiplier to vary the engine fueling command. Slight changes in either MAF or MAP can result in a change in cells and a new cell value to be used in the engine fueling command determination. The difference in cell values between even adjacent cells can be significant such that a change in cells can result in a substantial change in engine fueling and thus in engine output torque, which can result in engine instability, increased engine emissions, and reduced engine performance.

Figure 3:
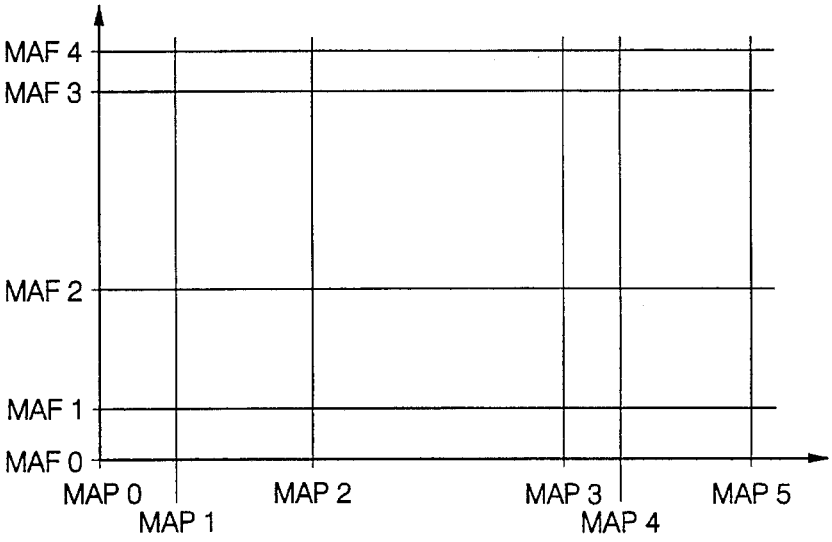
FIG. 3 is the adaptive block learn cell structure diagram in accord with this invention.

The cell structure and cell maintenance operations in accord with this invention overcomes such performance and stability problems by adapting the cell structure in accord with changing engine operating conditions. Rather than rely on fixed cell boundaries determined under static calibration conditions, cell boundaries are allowed to vary as needed to provide up-to-date cell values without substantial changes in cell values between neighboring cells. Specifically, the cell structure of FIG. 3, which may be stored in non-volatile RAM 50 (FIG. 1) describes that for this invention, the cell boundaries, as defined for engine parameters, such as MAF and MAP, may vary causing variation in the range of parameters that any one cell may cover. If engine conditions require that a certain cell within the structure requires a narrow range of parameter coverage, the approach of this invention will adjust the cell range accordingly. Cells may be added, removed and updated in accord with current engine operating conditions to reform the cell structure to provide for smooth transition between cells and to provide for up-to date cell values corresponding to closed-loop air/fuel ratio information.

Figure 4A:
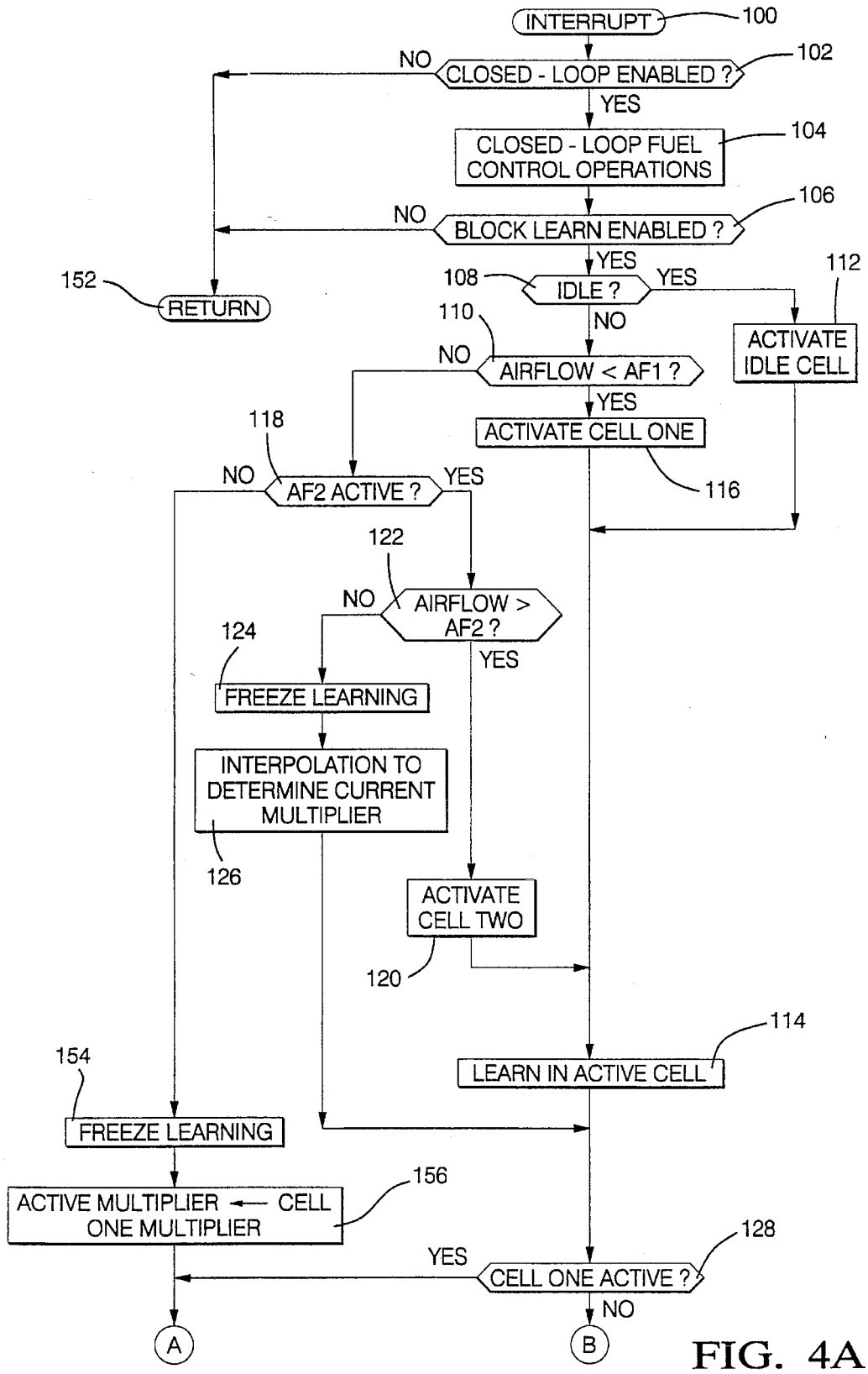
FIGS. 4–6 are computer flow diagrams illustrating the series of controller operations for carrying out the preferred embodiment of this invention.
Figure 4B:
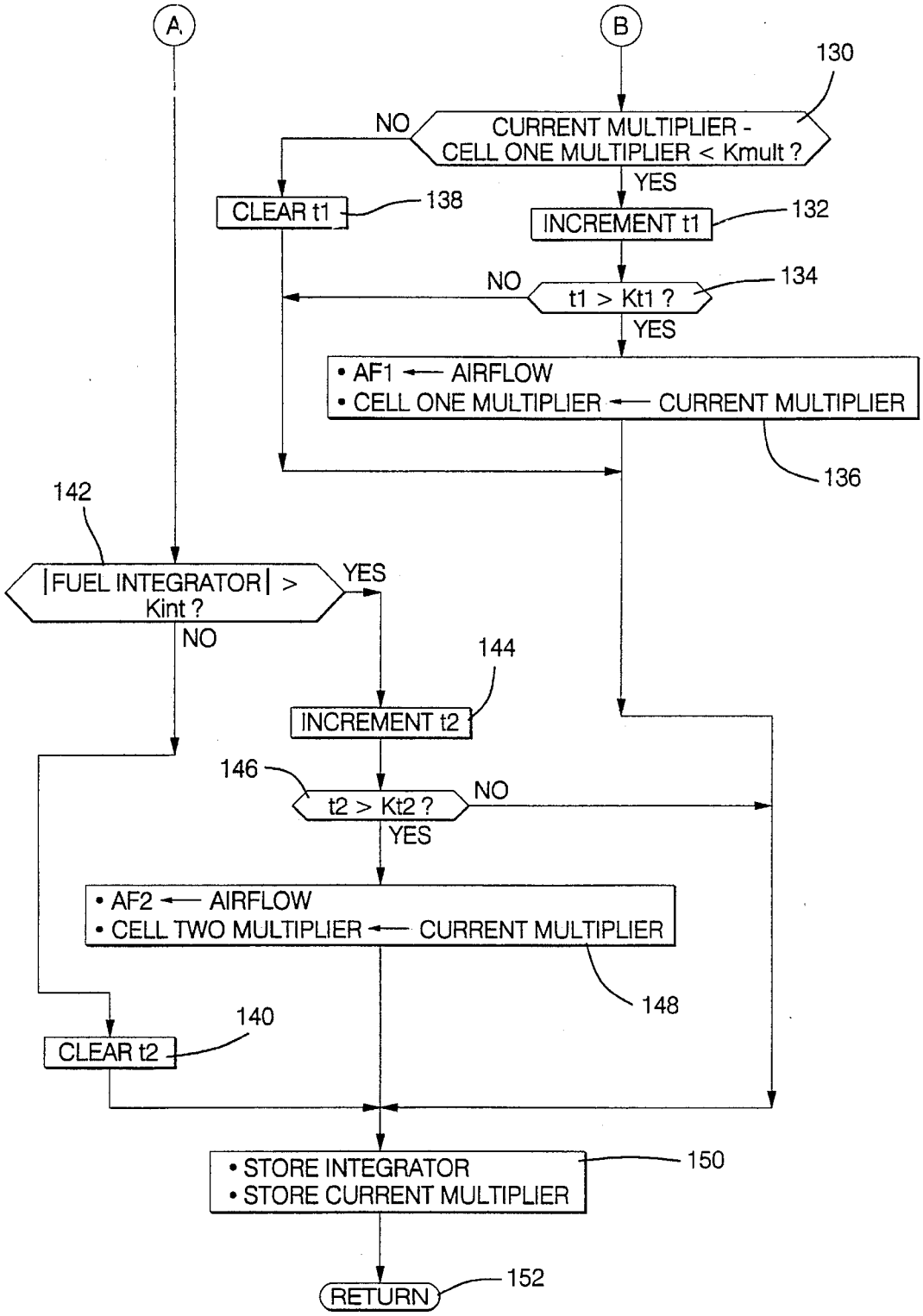
Figure 5:
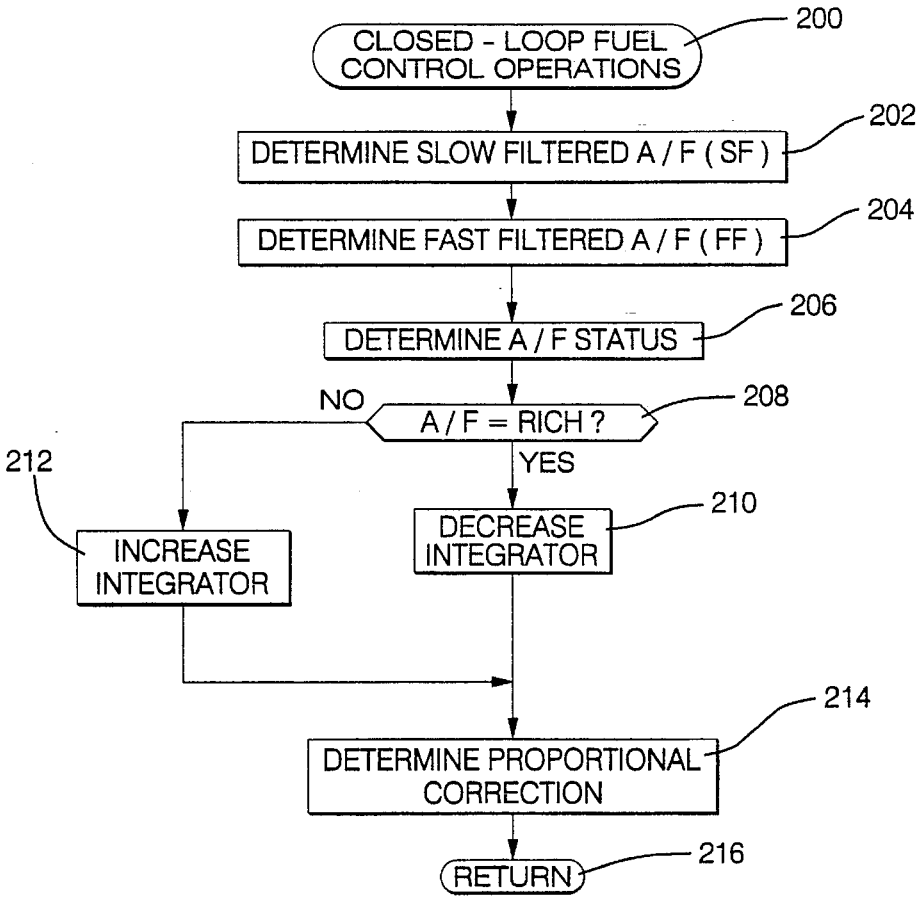
Figure 6:
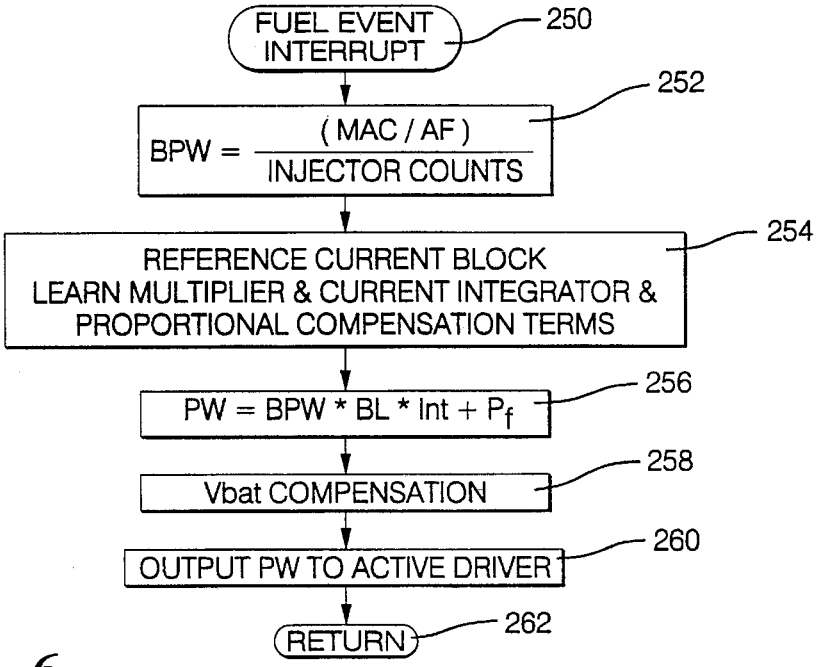

The controller operations to provide for such dynamic cell structures are described for the current embodiment by the step-by-step operations of FIGS. 4–6. The operations may be stored in controller ROM 44 (FIG. 1) as a series on CPU instructions to be carried out by the CPU 40 (FIG. 1) under the direction of its conventional control circuitry. The operations of FIG. 4 are to be executed periodically by the controller 36, such as about every 100 milliseconds while the controller is operating. Generally, these operations define and maintain the cell structure for a closed-loop fuel control block learn operation, and provide for cell learning and for referencing and updating a current cell value. The series of operations may be initiated as an interrupt service routine, or part thereof, upon occurrence of a standard timer interrupt set up to occur about every 100 milliseconds. Upon occurrence of the interrupt, any ongoing controller operations of a lower priority may be temporarily suspended to provide for the carrying out of conventional interrupt service operations, including those of FIG. 4, beginning at a step 100 and proceeding to a next step 102 to determine if closed-loop operations are enabled. In this embodiment, closed-loop operations provide for air/fuel ratio feedback information from signal EOS of FIG. 1 to be used for closed-loop engine air/fuel ratio control. Closed-loop operations will be enabled if the signal EOS of FIG. 1 is currently actively switching between lean and rich indications and if the signal TEMP has been in excess of five degrees Celsius for at least ten seconds. If closed-loop is not enabled, the routine is exited at a next step 152, to return to the suspended operations, and to provide for open-loop engine control operations, as are generally understood in the art.

If closed-loop is enabled at the step 102, closed-loop fuel control operations are next carried out at a step 104 by proceeding to the operations illustrated in FIG. 5, beginning at a step 200 and proceeding to a step 202 at which a slow filtered air/fuel ratio term SF is determined by passing the signal EOS through a predetermined filtering process having a predetermined slow filter coefficient corresponding to a significant lag in the filter. The SF value is stored in RAMP 50 (FIG. 1). A fast filtered air/fuel ratio term FF is next determined at a step 204 by passing the signal EOS through a predetermined filtering process having a predetermined fast filter coefficient corresponding to a light filtering of the EOS signal. The value FF is stored in RAM 50 (FIG. 1).

The air/fuel ratio status is next diagnosed as either rich or lean at a step 206, by analyzing the values SF and FF and a history of change in FF and SF, such as in a generally known manner in the art. U.S. Pat. No. 4,625,698, assigned to the assignee of this invention, illustrates one approach to determining the air/fuel ratio status that may be applied in accord with this embodiment. For example, if SF and FF both indicate a lean or both indicate a rich condition, the air/fuel ratio status is set to that condition. Otherwise, the air/fuel ratio status is maintained in its current condition.

If the determined condition is rich, a next step 208 directs controller operations to that of a next step 210 to decrease an integrator value by a predetermined amount, such as a count of one. Otherwise, the step 208 directs that the integrator value be increased by a predetermined amount, such as one. The integrator is used for integral compensation of the engine fueling command, as will be described. The integrator may be stored in RAM 50 (FIG. 1). A proportional correction term is next generated following the step p210 and following the step 212 at a step 214 as a function of a closed-loop air/fuel ratio error and a predetermined multiplicitive gain. The proportional correction term may be a positive value if FF currently indicates a lean condition and may be a negative value if FF currently indicates a rich condition. A reduction in magnitude of the proportional term may be applied if the current status of FF and SF is not in agreement. The proportional correction term may be stored in RAM 50 (FIG. 1). Following the step 214, the routine of FIG. 5 returns, via a step 216, to the routine of FIG. 4, to execute a next step 106 at which it is determined whether block learn operations are currently enabled.

Block learn operations provide for maintaining the cell structure of the block learn cells in accord with this invention, and for retrieval and updating, if necessary, of the cell value of an active cell, to be applied as a fuel command multiplier. Block learn operations are enabled in this embodiment when the engine is sufficiently warmed up to support accurate oxygen sensor activity, such as when engine temperature, as indicated by signal TEMP, is greater than about 85 degrees Celsius for twenty seconds. If block learn is not enabled, the described step 152 is executed. If block learn is enabled, a next step 108 is executed to determine of the engine is currently in an idle operating condition characterized by a closed inlet air valve 16 (FIG. 1) and a vehicle speed Vspd less than about five m.p.h. If an idle condition is present, an idle block learn cell is activated at a next step 112. The idle cell is a single adaptive cell in this embodiment, containing a single multiplier value adapted and applied when an idle operating condition is present, in accord with generally known idle air/fuel ratio control practices. After activating the idle cell, a step 114 is executed to learn in that active cell, such as by incrementing or decrementing the block learn value Bli for the active cell (cell i), if the integrator is above or below, respectively, a calibrated integrator deadband for a calibrated period of time. The updated block learn value is then restored in the active cell for future use. The step 118 is next executed, to be described.

Returning to the step 108, if an idle condition is not present, a step 110 is executed to compare engine inlet airflow AIRFLOW, as indicated by the output signal MAF of the mass airflow sensor 12 of FIG. 1, to a first threshold AF1, calibrated to a value corresponding to about twenty grams per second of intake air. The threshold AF1 represents an initial cell boundary for the one-dimensional fuel multiplier block learn table of this embodiment. Although the threshold is pre-set at calibration, it may be modified through the current block learn operations, as will be described. A cell is defined as being below and above the threshold AF1. Accordingly, if airflow is less than AF1, a first cell (cell one) is activated at a next step 116. Learning is carried out in this active cell at the described step 114, which is next executed, using the described learning equation. Following step 114, the described step 128 is executed.

If airflow is not less than AF1 at the step 110, a next step 118 is executed to determine if a second threshold AF2 is presently assigned a value. AF2 may be added through the block learn operations of this embodiment, if it is determined that closed-loop control improvements would so require, as will be described. IF AF2 is not active, then AF1 defines the only current threshold, and the current airflow is pointing outside of any current learning cell. Accordingly no learning is currently provided by freezing learning at a next step 154, such as by assigning an appropriate value to a flag in controller RAM 50 (FIG. 1) and then establishing the cell one multiplier as the current active multiplier at a next step 156. After activating the cell one multiplier, a next step 142 is executed, to be described.

If AF2 is active as determined at the described step 118, then there are three regions defined by thresholds AF1 and AF2 currently making up the block learn table, and a next step 122 is executed to determine which cell is active. If airflow is greater than AF2 at the step 122, then a cell two is active and otherwise a cell intermediate cells one and two is active. If cell two is active, an activation flag is set at a next step 120, and learning is provided in the active cell at the described step 114. If the intermediate cell is active as determined by airflow being less than AF2 at the step 122,, a next step 124 freezes learning, such as by setting a flag in controller RAM 50 (FIG. 1) used to determine whether learning is to be carried out for the current interrupt. A block learn multiplier is next determined at a step 126, such as by interpolating between the multiplier values for the cell one and the cell two. This multiplier value represents the block learn value that is to be used in the fueling determination of FIG. 6, to be described. The interpolation process of step 126 may be any standard interpolation process. For example, the resultant multiplier magnitude should be positioned between the cell one multiplier magnitude and the cell two multiplier magnitude with substantially the same magnitude position that the current airflow has relative to the magnitude of AF1 and AF2.

Alternatively, a cell may be defined intermediate the cells one and two of the current block learn table, and learning may occur in such cell in the manner described at the step 114. Still further, additional cells may be defined for airflow values above AF2, simply by extending the conditional operations beyond those of steps 110, 112, and 122. For example, if airflow was determined to be greater than AF2 at the step 122, a next conditional operation may then be executed to determine if AF3 is active. If so, then a comparison of AF3 and current airflow may be made to determine the proper active cell, with each airflow range having a corresponding learned cell multiplier, or with intermediate cells using interpolation to determine an appropriate multiplier value, such as was described for the step 126. Still further, AF4, AF5, etc. may be activated in accord with this invention defining additional ranges each range having a stored multiplier that may be learned or determined using the described interpolation process of step 126.

After determining the current multiplier at the step 126, or after learning in the current cell at the step 114, a step 128 determines if cell one is active. If so, or following the step 156, the magnitude of the current fuel integrator is compared to a calibration value Kint to determine the amount of compensation currently required to mitigate the current air/fuel ratio error. Kint is determined in a conventional calibration process as approximately ± two percent. If the integrator magnitude exceeds Kint; a counter value t2 is incremented at a next step 144, and is then compared to a calibrated counter threshold Kt2 of about five seconds at a next step 146. If t2 exceeds Kt2, then the integrator magnitude has been above the threshold for a sufficient time that it may be assumed the current cell structure is not adequately providing for air/fuel ratio error compensation. Accordingly, the cell structure is adapted for the current deficiency in accord with this invention, by proceeding to a next step 148 at which a new cell is defined or the old cell two is replaced, by setting AF2 to the current airflow value, and by storing the current multiplier value as the cell two multiplier value. AF2 is then active for use in the block learn operations described above for the routine of FIG. 4. The integrator and the current multiplier are next stored for use in subsequent fuel control operations at a next step 150. The integrator is stored in RAM 50 (FIG. 1) and the multiplier is stored in a non-volatile RAM device, so that it may be used over more than the current vehicle operating cycle.

Returning to the step 142, if the magnitude of the fuel integrator is not greater than Kint, t2 is cleared at a next step 140. Next, or if t2 was determined to not be greater than Kt2 at the step 146, then the described step 150 is executed. Returning to the step 128, if cell one is not currently active, a difference between the current multiplier and the cell one multiplier is compared to a predetermined calibration value Kmult, set to approximately ±0.8 percent in this embodiment, at a step 130. If the difference is less than Kmult, than a timer t1 is incremented at a next step 132. If the timer value exceeds Kt1 at a next step 134, the multiplier from cell one is allowed to learn up to the current multiplier value at a next step 136. Specifically, the AF1 value is assigned the current airflow value, and the cell one multiplier is assigned the value of the current multiplier. This is to provide for learning of the cell one multiplier value when it is assumed that a transient condition resulting in additional cell definition has substantially subsided and as it is assumed the current multiplier contains more current multiplier information than does that of cell one. Accordingly, cell one is redefined by learning up into the current multiplier value, such as the multiplier value of cell two or of the intermediate multiplier between cells one and two.

In a further embodiment in accord with this invention, additional cells may be added through the operations of step 128, and 140–148, by monitoring the fuel integrator magnitude for any current cell. If the integrator persists at a value exceeding a calibrated threshold, such as threshold Kint described at the step 142 while in any cell, a new cell may be required and may be set up using current airflow as the cell threshold, and using the current multiplier values as the cell value. Additionally, such additional cells may be removed through the operations of step 128–138, by monitoring a difference between the current multiplier and the closest multiplier of a lesser magnitude. If the current multiplier persists at a magnitude that is within a calibrated magnitude of such closest cell multiplier, the cell multiplier may be re-defined through the process of the step 136.

Returning to the step 130, if the difference between the current multiplier and the cell one multiplier is not less than Kmult, t1 is cleared at a next step 138. Next, or if t1 is not greater than kt1 at the step 134, the described step 150 is executed. Following the step 150, the routine returns to the temporarily suspended operations via a next step 152. The service routine including the operations of FIG. 4 also includes standard interrupt maintenance operations providing for continued interrupts to occur at a predetermined frequency, such as about every 100 milliseconds, as described.

In addition to timer interrupts, the controller 36 of FIG. 1 may operate under a number of event-based interrupts used to carry out operations synchronized with specific engine events, such as engine cylinder events. One such interrupt includes fuel control operations in which a fuel command is generated and issued to the injector drivers 38 of FIG. 1. This interrupt is set up through standard controller initialization operations (not shown) to occur at least once for each engine cylinder event, such as at least once for each cylinder intake, exhaust, compression, or expansion stroke of the four cycle engine of this embodiment. When such an interrupt occurs, and it has been determined that a fueling command must be generated (such as for each interrupt corresponding to a cylinder intake stroke), conventional fueling control, diagnostic and maintenance operations may be executed as is generally understood in the art. Among such operations for the current embodiment are those fuel event interrupt service operations of FIG. 6, which are initiated beginning at a step 250, and proceed to calculated a base pulse width command BPW at a next step 252 as the quotient of a mass airflow per cylinder MAC value and a current desired air/fuel ratio value AF, divided by an injector count constant representing the number of milliseconds of injector open time per unit of injected fuel. The desired air/fuel ratio may correspond to the stoichiometric air/fuel ratio.

The current multiplier, for example as was determined through the described steps of the routine of FIG. 4, and the current integrator and proportional terms as were determined through the operations of the routine of FIG. 5 are next referenced at a step 254. A fuel pulse width command PW is then generated using such referenced terms at a next step 256, as follows $$PW=BPW*BLM*INT+Pf$$

in which BLM is the current block learn multiplier, INT is the current integrator value, and Pf is the proportional term for fuel compensation. In the event of open loop operations, both BLM and INT may be set to unity, and in the event block learn operations are not active, BLM may be set to unity.

To account for injector performance variation caused by Vbat disturbances, the pulse width command PW is next compensated in accord with the current Vbat voltage level at a step 258, such as by increasing PW to account for decreased injector responsiveness caused by a decrease in Vbat below a predetermined level. The compensated PW is next output to the drivers 38 of FIG. 1 for timed application to the fuel injector corresponding to the engine cylinder about to undergo its intake event, as is generally understood in the art. After outputting the PW command the routine returns to any suspended operations via a step 262.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. An engine control method for generating a control signal applied to control an actuator to drive a value of an automotive internal combustion engine air/fuel ratio control parameter to a target air/fuel ratio parameter value, comprising the steps of:

storing, in a memory device, a block learn array comprising a plurality of adjacent cells corresponding to a plurality of adjacent engine operating condition ranges, each of the plurality of cells having a cell value;

repeatedly, (a) sensing a current engine condition, (b) determining whether a learn state is present in which the current engine condition is within any of the operating condition ranges of the block learn array, (c) if a learn state is present, then (i) identifying an active cell of the array as the block learn array cell having an engine operating condition range including the current engine condition and (ii) determining an active cell value by adjusting the cell value of the active cell in direction to drive the control parameter value toward the target parameter value, (d) if a learn state is not present, then (i) identifying an active cell of the array as the block learn array cell having an engine operating condition range closest to the current engine condition and (ii) determining an active cell value as the cell value of the active cell, (e) generating the control signal as a function of the determined active cell value, and (f) applying the control signal to control the engine air/fuel ratio control parameter;

determining a value indicating a degree of deviation of the control parameter value away from the target parameter value;

comparing the determined value to a predetermined threshold value over a predetermined monitoring period;

adding a cell to the block learn array when the determined value exceeds the threshold value over the predetermined monitoring period;

comparing cell values of at least one pair of neighboring cells in the block learn array over a predetermined comparing period; and reducing the number of cells of the block learn array when the cell values of the at least one pair are substantially the same over the predetermined comparing period.

2. The method of claim 1, wherein the adding step further comprises the steps of:

defining a new engine operating condition range corresponding to the added cell as a range extending from a predetermined engine condition within the active cell to the current engine condition;

and defining a cell value for the added cell as a predetermined function of the determined active cell value.

3. The method of claim 1, wherein the reducing step comprises the steps of:

combining the at least one pair of neighboring cells into a single cell of the block learn array, the single cell corresponding to an engine operating condition range that extends over the range of both of the neighboring cells, and the single cell having a cell value determined as a predetermined function of the cell values of the neighboring cells.

4. The method of claim 1, wherein the cell values of the at least one pair of neighboring cells are substantially the same when the difference between said cell values of said at least one pair of neighboring cells is less than a predetermined difference threshold.

5. The method of claim 1, wherein the automotive internal combustion engine control parameter is engine air/fuel ratio, and the control signal is a predetermined one of a fuel injector drive signal and an intake air rate control signal.

6. An internal combustion engine fuel control method for controlling the quantity of fuel delivered by at least one fuel injector to the engine in accord with a generated fuel command, to drive engine air/fuel ratio toward a target air/fuel ratio, comprising the steps of:

providing a stored block learn array comprising a plurality of adjacent cells corresponding to a plurality of adjacent engine operating condition ranges, each of the plurality of cells having a cell multiplier;

repeatedly, (a) sensing a current engine operating condition, (b) identifying an active cell of the array as the block learn array cell having an engine operating condition range including the current engine operating condition, (c) referencing the multiplier from the active cell, (d) referencing a fuel control correction value, (e) generating the fuel command as a predetermined function of the referenced multiplier and fuel control correction value, and (f) controlling the at least one fuel injector by outputting the fuel command; and maintaining the block learn array by repeatedly, (a) sensing actual engine air/fuel ratio, (b) varying the fuel control correction value as a predetermined function of the difference between actual engine air/fuel ratio and the target air/fuel ratio, (c) determining an active cell of the block learn array, (d) determining when a predetermined learn state is active, (e) adjusting, when the learn state is active, the cell value of the determined active cell in direction to drive the fuel control correction value toward zero, (f) comparing the fuel control correction value to a predetermined constant over a predetermined monitoring period, (g) adding a new cell to the block learn array if the fuel control correction value exceeds the constant over a predetermined monitoring period, (h) determining, when the learn state is active, if the adjusted cell value is substantially the same as a cell value of a cell adjacent the determined active cell in the block learn array, and (i) removing a cell from the block learn array if the adjusted cell value is substantially the same as the cell value from the adjacent cell.

7. The method of claim 6, wherein the adding step further comprises the steps of:

defining a new engine operating condition range corresponding to the added cell as a range extending from a predetermined adjacent engine operating condition within the active cell to a current engine operating condition;

defining, when the learn state is active, a new cell value for the added cell as a predetermined function of the adjusted cell value of the active cell; and defining, when the learn state is not active, a new cell value for the added cell as a predetermined function of the cell value of the active cell.

8. The method of claim 6, wherein the removing step comprises the steps of:

combining the determined active cell and the cell adjacent the determined active cell into a single cell of the block learn array, the single cell corresponding to an engine operating condition range that extends over the range of both the determined active cell and the cell adjacent thereto, and the single cell having a cell value determined as a predetermined function of the cell value of the determined active ell and of the cell value of the cell adjacent the determined active cell.

9. The method of claim 6, wherein the cell values of the determined active cell and the cell adjacent the determined active cell are substantially the same when the difference between said cell values is less than a predetermined difference threshold.

* * * * *